US005542193A

United States Patent [19]

Sims et al.

[11] Patent Number: 5,542,193

[45] Date of Patent: Aug. 6, 1996

[54] DRYER GROUP FOR CURL CONTROL

[75] Inventors: Duke N. Sims, Roscoe, Ill.; Gregory L. Wedel, Beloit, Wis.

[73] Assignee: Beloit Technologies, Inc., Wilmington, Del.

[21] Appl. No.: 192,685

[22] Filed: Feb. 7, 1994

Related U.S. Application Data

[63] Continuation-in-part of Ser. No. 95,135, Jul. 21, 1993, Pat. No. 5,283,960, which is a continuation of Ser. No. 873,420, Apr. 24, 1992, Pat. No. 5,269,074.

[51] Int. Cl.[6] ..... F26B 11/02

[52] U.S. Cl. ..... 34/117; 34/445; 34/446

[58] Field of Search ..... 34/117, 446, 454

[56] References Cited

U.S. PATENT DOCUMENTS

| | | | |
|---|---|---|---|
| 2,046,553 | 7/1936 | Edwards | 34/454 |
| 2,062,992 | 12/1936 | Klünsch | 34/454 |

(List continued on next page.)

FOREIGN PATENT DOCUMENTS

| | | |
|---|---|---|
| 0426607A2 | 8/1991 | European Pat. Off. . |
| 345266B1 | 3/1993 | European Pat. Off. . |
| 9001209.7 | 5/1990 | Germany . |
| 305229 | 1/1971 | U.S.S.R. . |
| 1121341 | 10/1984 | U.S.S.R. . |
| 2173832 | 10/1986 | United Kingdom . |
| 8202937 | 9/1982 | WIPO . |
| 8300514 | 2/1983 | WIPO . |
| WO88/04206 | 6/1988 | WIPO . |
| WO88/06204 | 8/1988 | WIPO . |
| WO88/06205 | 8/1988 | WIPO . |

OTHER PUBLICATIONS

Paper Age; Nov. 1991; pp. 12–13 by Tim Bal and J. Yli–Kaupppila.

"Effect of Water Retention Value (WRV) on The Paper Web Drying Process"; Cellulose Chem. Technol.; pp. 451–464, 1986; by K. Przybysz and J. Czechowski.

Paper given by Valmet at Apr. 1989 CPAA Printing Conference; untitled; pp. 1–14.

"Relation Between Drying Stresses and Internal Stresses and the Mechanical Properties of Paper" by M. Htun & A. de Ruvo; Published Sep. 1977; pp. 2–13; Conference Literature.

G. L. Wedel et al., *Advances in Dryer Section Runnability, TAPPI Journal*; Sep. 1987; pp. 65–69.

I. Binns; *Examining Runnability in the Dryer Section*; Jul., 1987; pp. 27–28.

*No. 16 Takes Shape*; Consolidated News, vol. 29, No. 4, Aug.–Oct. 1991; pp. 8–10.

T. Bal et al.; *Valmet's Sym–Run Concept: a New Tool for High–Speed Drying; Paper Age*; Nov. 1991; pp. 12–13.

(List continued on next page.)

*Primary Examiner*—Henry A. Bennett
*Assistant Examiner*—Dinnatia Doster
*Attorney, Agent, or Firm*—McAndrews, Held & Malloy, Ltd.

[57] ABSTRACT

A drying apparatus is disclosed for drying a web of paper. The apparatus includes more than one top felted dryer group for drying the web. The web may be restrained against cross-machine and machine directional shrinkage during passage of the web through the plurality of dryer groups. A last dryer group is located downstream relative to the plurality of drying groups so that the web extends between the plurality of drying groups and the last dryer group. The last dryer group can be a double felted two tier dryer group. The web extends in an open draw between each dryer cylinder of the upper and lower tiers of the last dryer group, so any tendency of the web to curl is controlled during movement of the web through the last dryer group. Alternative arrangements are also described.

48 Claims, 10 Drawing Sheets

U.S. PATENT DOCUMENTS

| | | | |
|---|---|---|---|
| 2,537,129 | 1/1951 | Goodwillie | 92/49 |
| 2,714,342 | 8/1955 | Beachler | 92/53 |
| 2,929,450 | 3/1960 | Kurz | 162/379 |
| 2,959,222 | 11/1960 | Hornbostel | 162/360 |
| 3,079,699 | 3/1963 | Fry, Jr. | 34/13 |
| 3,110,612 | 11/1963 | Gottwald et al. | 117/64 |
| 3,263,344 | 8/1966 | Stickle | 34/116 |
| 3,395,073 | 7/1968 | Davis, Sr. | 162/369 |
| 3,416,237 | 12/1968 | Sutherland et al. | 34/446 |
| 3,564,724 | 2/1971 | Keyes, VI et al. | 34/48 |
| 3,658,642 | 4/1972 | Keyes, IV et al. | 162/197 |
| 3,833,466 | 9/1974 | McCarty | 162/142 |
| 3,868,780 | 3/1975 | Soininen et al. | 34/116 |
| 3,874,997 | 4/1975 | Kankaanpää | 162/290 |
| 3,925,906 | 12/1975 | Chance et al. | 34/18 |
| 3,939,034 | 2/1976 | Tanaka et al. | 156/522 |
| 4,000,035 | 12/1976 | Schiel et al. | 162/290 |
| 4,146,972 | 4/1979 | Smith, Jr. | 34/41 |
| 4,183,148 | 1/1980 | Koski et al. | 34/23 |
| 4,202,113 | 5/1980 | Kankaanpaa | 34/23 |
| 4,314,878 | 2/1982 | Lee | 162/198 |
| 4,359,827 | 11/1982 | Thomas | 34/16 |
| 4,359,828 | 11/1982 | Thomas | 34/114 |
| 4,441,263 | 4/1984 | Vedenpää | 34/115 |
| 4,481,723 | 11/1984 | Vedenpää | 34/114 |
| 4,483,083 | 11/1984 | Chance | 34/113 |
| 4,510,698 | 4/1985 | Ely | 34/117 |
| 4,539,762 | 9/1985 | Eskelinen et al. | 34/114 |
| 4,566,944 | 1/1986 | Mauranen et al. | 162/286 |
| 4,608,124 | 8/1986 | Mauranen et al. | 162/193 |
| 4,625,430 | 12/1986 | Aula et al. | 34/13 |
| 4,625,434 | 12/1986 | Karlsson et al. | 34/114 |
| 4,677,762 | 7/1987 | Futcher | 34/114 |
| 4,686,778 | 8/1987 | Kotitschke et al. | 34/117 |
| 4,744,156 | 5/1988 | Futcher | 34/114 |
| 4,881,327 | 11/1989 | Hauser et al. | 34/114 |
| 4,934,067 | 6/1990 | Wedel | 34/41 |
| 4,980,979 | 1/1991 | Wedel | 34/23 |
| 4,982,513 | 1/1991 | Loser et al. | 34/116 |
| 4,986,009 | 1/1991 | Haessner et al. | 34/23 |
| 5,062,216 | 11/1991 | Hannigan | 34/16 |
| 5,101,577 | 4/1992 | Wedel | 34/114 |
| 5,269,074 | 12/1993 | Sims et al. | 34/117 |
| 5,283,960 | 2/1994 | Sims et al. | 34/117 |
| 5,291,666 | 3/1994 | Babinsky et al. | 34/117 |
| 5,377,428 | 1/1995 | Clark | 34/446 |
| 5,379,528 | 1/1995 | Oechsle | 34/446 |

OTHER PUBLICATIONS

E. Beuleke; *Trockenpartie*; 45. Jahrgang. heft 10A. 1991, *Innovations In The Area Of The Paper Machine. (3). Dryer Section.*

J. Pulkowski; *Operating Results with the Bel–Champ Single–Tier Dryer*; 1990 Engineering Conference, TAPPI Proceedings; pp. 393–398.

G. L. Wedel; "No–Draw Drying Restraint"; 1988 Engineering Conference, TAPPI Proceedings; pp. 275–281.

G. L. Wedel et al.; *Dryer Section Runnability*; 1987 Engineering Conference, TAPPI Proceedings; pp. 279–286.

S. Palazzolo; "No–Draw Drying"; TAPPI Notes; 1991, pp. 61–64.

Dr. R. Field; "Properties And Uniformity Improved By Single–tier Drying"; Paper Technology; Apr. 1991, pp. 36–39.

G. L. Wedel; *Drying Restraint in a Single–Tier Dryer Section*; 1989 Annual Meeting, TAPPI Proceedings; pp. 23–28.

N. P. Black; *Changes In Paper Technology Will Result In Major Changes In The Designs And Capabilities Of Paper Machines*; TAPPI Journal, Jan. 1991, pp. 69–72.

J. L. Chance; *Restrained Drying: Commercial Experience*; Paper presented at 45th Annual General Conference Melbourne 1991.

H. Ilvespaa et al. *Single–Felted Drying Boosts Paper Machine Efficiency*, "Paper Quality" Pulp & Paper, Mar. 1991, pp. 134–136.

Heinback–Seminar; Oct. 6, 1989; J. Fischer; "Neue Elemente Bei Der Papiertrocknung"; (J. M. voith gmbH) translation—New Elements in Paper Drying.

Voith, GmbH, and Voith, Inc. v. Beloit Corporation, Civ. Action No. 93c0905c, Prior Art Statement Pursuant To 35 USC § 282, Apr. 17, 1995, p. 5.

CPI # 16.

James Maclaren PM # 3 and SCA Ortviken PM #5–1 page.

Leykhem, Bruck, Austria, GD–133939–1–0–0.

Champion Int., Quinnesec PM #41, MA–A747–1–0–0.

Bear Island, PM#2, LF–133911–4–0–0.

Bear Island, PM#2, LF–133911–4–1–0.

Bear Island, PM#2, LF–133911–4–2–0.

S. D. Warren, PM#3, GD–134009–1–0–0.

Mead, Escanaba—LF–130400–4–2–0.

Newsprint South Granada, PM#1, MA–A750–3–0–0.

Duluth PM#2, 1.12–16 176.

Union Camp, PM#2, 21.

DRYER GROUP FOR CURL CONTROL

The present application is a continuation-in-part of U.S. Ser. No. 08/095,135, filed Jul. 21, 1993, now U.S. Pat. No. 5,283,960, which is a continuation of U.S. Ser. No. 07/873,420, filed Apr. 24, 1992, now U.S. Pat. No. 5,269,074. Each of the foregoing applications is hereby incorporated by reference herein in its entirety to provide continuity of disclosure.

The present invention relates to a paper making machine for making a web of paper from a fluid furnish. More particularly, the present invention relates to a dryer for a paper making machine having multiple groups of dryers, so arranged as to control curl in a web which develops latent curl when it is partially dry.

BACKGROUND OF THE INVENTION

In the manufacture of lightweight paper grades, such as newsprint and fine paper, the web is commonly dried on a series of steam-heated drying cylinders. The wet web is pressed directly onto the cylinders by a series of tensioned, permeable fabrics or felts.

In a conventional double-felted, two tier dryer group, the wet web passes from one cylinder to the next in a generally serpentine fashion through long, unsupported "open draws". The majority of the water vapor that leaves the sheet or web is released in these open draws.

Problems have been experienced during operation of conventional dryer groups with regard to sheet flutter during movement of the web through a open draws. This problem particularly occurs in the "wet end" of the dryer, where the web is still quite wet.

A fluttering web is subject to frequent web breaks, which are expensive and time-consuming to correct. Even an occasional web break is a very big problem. It can damage the felt and even the machine, and it inevitably causes production of paper to stop until any necessary repairs can be made and the web can be re-threaded in the running machine.

While a web break is being corrected, a web of undried paper as wide as the machine (often about 30 feet or nine meters wide) and miles (several km.) long is formed and must be collected, broken up, mixed with a much larger quantity of water, and recycled in the paper machine.

Machine speeds, and thus the amount of paper a machine could produce, were limited prior to the present invention by the need to avoid an excessive number of web breaks by keeping the web speed low enough to minimize its flutter in open draws. Even after taking this precaution, web breaks were a common occurrence.

Also, in conventional dryer groups, problems are caused by cross-directional sheet shrinkage and inefficient ventilation of evaporated water.

Additionally, conventional double felted two tier dryer groups typically require threading ropes in order to thread a tail of the web.

Some of the problems with sheet flutter, sheet shrinkage, and vapor ventilation have been solved by using one or more top-felted single tier dryer groups in the wet end of the dryer. These partially top-felted single tier dryers are sold by Beloit Corporation under the trademark "BELRUN".

The series of top-felted dryer groups has not been continued all the way to the dry end of the dryer because each top-felted single tier dryer only directly contacts one side of the web—specifically, the bottom side—with the heated surfaces of the drying cylinders. A typical dryer including single tier sections has approximately 41 percent of the dryer cylinders in top-felted single tier groups, and the remaining 59 percent of the dryer cylinders are two tier, double felted dryer cylinders.

The actual and perceived problems associated with conventional two tier dryer groups and with dryers consisting entirely of top-felted single tier dryer groups have been addressed by the development of a dryer having alternating top-felted and bottom-felted single tier dryer groups, often running the full length of the dryer. Such dryers have been sold, for example, under the trademark "BEL-CHAMP" by Beloit Corporation. The alternating dryer groups, which usually are positioned in a generally horizontal, staggered series, alternately dry both sides of the web.

It was well known when alternating single tier dryers were developed that the sheet tends to curl towards the last side of the web to be dried, at least in laboratory studies. To be sure that both sides would dry at the same time, both sides were dried alternately, beginning in the very early stages of drying.

Concern about sheet curl led dryer group builders to dry alternate sides even in the very early stages in the alternating single tier dryers. For example, the #3 machine at CTS, Duino, Italy, was designed with the first three dryer cylinders top felted, the next three bottom felted, and the following three top felted. These first three groups were designed this short to ensure alternate-sided drying would be started in the very early stages of the drying process.

Those skilled in the art believed that preferentially drying the web on one side would create an imbalance in drying on the respective sides of the web, leading to a problem with sheet curl.

One difficulty with the alternating single tier dryer is that none of its dryers are stacked vertically by providing upper and lower tiers of dryers. Conventionally, the successive dryer cylinders are in a generally horizontal arrangement rather than in a two tier arrangement. Thus, the machine can be longer than earlier machines which have the same number and size of dryer cylinders.

The alternating single tier configuration also commonly requires an extra vacuum roll at each of the transfers from one dryer group to another.

In addition, although web breaks are infrequent in alternating single tier dryers, when the web does break, if it then wraps around a bottom felted dryer cylinder, the wrapped paper cannot be easily dumped into the basement. (The "basement" of a paper machine is the open space beneath the machine where the "broke" or useless, partially made paper produced by an unthreaded machine is collected for recycling in the machine.) Rather, the broke must be manually removed from the bottom felted dryer group by a worker. The manual removal of broke is time-consuming, and often must be done while the machine is stopped. Top-felted groups are open beneath the web, so broke automatically goes into the basement when the web breaks, or can be easily diverted there.

Also, in the alternating single tier arrangement, any one dryer group preferentially dries one side of the web. According to conventional thinking, the sheet must be reversed periodically by passing it through top-felted and bottom-felted groups to avoid curl. Conventional thinking has thus been that latent curl of the web cannot be controlled within the same group where it develops; it must be controlled by passing the web through a subsequent, oppositely felted group.

SUMMARY OF THE INVENTION

One aspect of the invention is a paper making machine including an upstream portion, a dryer, and a downstream end. (The terms "upstream" and "downstream" are directions along the running web of paper, which is considered to run, like a river, from upstream to downstream.)

The upstream portion of the paper making machine is capable of forming a wet web of paper.

The dryer of the paper making machine is capable of removing water from the web. If the paper making machine includes a size press, the dryer is defined to include both the pre-dryer portion upstream of the size press and the post-dryer portion downstream of the size press. The dryer includes a first or upstream dryer portion and a second or downstream dryer portion.

The downstream end of the paper making machine is where the paper leaves the paper making machine in the form of substantially dry paper. "Substantially dry paper" means paper having less than about 10% water content. The downstream end of the paper making machine is downstream of any size press or other apparatus on the machine which increases the water content of the running web.

The first portion of the dryer is capable of preferentially drying a first side of the web. "Preferentially drying" means drying one side of the web more than the other, as by providing more direct contact with heated dryer cylinders on one side of the web than on the other side or by contacting one side of the web with hotter dryer cylinders than the other side of the web is exposed to.

The first dryer portion preferably is capable of drying the web to a dryness of at least about 70%, and is capable of producing or contributing to a latent curl in the web.

"Latent curl" is defined herein as the condition in the undried web which can later cause the dry web to curl. Preferential drying to a certain dryness, unequal application or take-up of sizing on the respective sides of the web, and other factors can produce or contribute to latent curl. The minimum dryness of the webat which preferential drying will cause curl depends on the type of furnish used, the type of the machine used, operating conditions, and other factors.

The second dryer portion is located between the first dryer portion and the downstream end of the machine. If the paper making machine includes a size press, the second dryer portion can be entirely upstream of the size press, entirely downstream of the size press, or divided between portions upstream and downstream of the size press.

In the preferred embodiment, the second dryer portion includes at least one dryer group which is capable of drying each of the first and second sides of the web. The respective sides of the web are dried in relative amounts which at least reduce the degree of the latent curl in the web. If the machine has a size press, the dryer group or groups capable of performing this function may be upstream of the size press, downstream of the size press, or divided between portions respectively upstream and downstream of the size press.

A dryer group for drying both sides of the web may optionally be a group in which the web is alternately dried on one side and the other by direct contact with heated dryer cylinders as it proceeds from one dryer cylinder to the next one. A conventional dryer group of this kind is the double felted two tier dryer group.

A dryer group for drying both sides of the web may optionally be a group in which all the dryer cylinders are contacted by one felt (directly or with only the web separating them). These groups may be what are conventionally known as single tier dryer groups, single-felted two tier dryer groups, or other configurations. Some configurations may require auxiliary apparatus like hot air caps to dry both sides of the web.

Another aspect of the invention is a drying apparatus for drying a web of paper, the apparatus comprising more than one dryer group. Each of the dryer groups before the last one includes more than one dryer cylinder, more than one vacuum roll, and a dryer felt.

The dryer cylinders of all but the last dryer group are located in a single tier configuration. The vacuum rolls are each located between two adjacent dryer cylinders. The dryer felt extends alternately around each dryer cylinder and each vacuum roll. Each of the dryer cylinders is top felted so that broke removal is facilitated, and each of these dryer groups is arranged in succession.

The last dryer group is located downstream from the other dryer groups so the web is transferred directly or indirectly from the second-last dryer group to the last dryer group. The last dryer group includes upper and lower tiers.

The upper tier includes an upper tier of dryer cylinders, an upper tier of felt rolls located between adjacent dryer cylinders of the upper tier, and an upper felt extending alternately around each dryer cylinder and felt roll of the upper tier. The lower tier includes an lower tier of dryer cylinders, an lower tier of felt rolls located between adjacent dryer cylinders of the lower tier, and an lower felt extending alternately around each dryer cylinder and felt roll of the lower tier. One embodiment of the last dryer group is a double felted two tier dryer group.

Another aspect of the invention is another drying apparatus for drying a web of paper. The apparatus includes more than one dryer group for drying the web. All but the last dryer group includes more than one dryer cylinder located in a single tier configuration, more than one vacuum roll, and a dryer felt. Each vacuum roll is located between adjacent dryer cylinders of the plurality of dryer cylinders. The dryer felt extends alternately around each dryer cylinder and each vacuum roll. Each of the dryer cylinders is top felted so that broke removal is facilitated, each of the dryer groups being arranged in succession.

The last dryer group is located downstream of the other dryer groups so the web extends from the second last dryer group to the last dryer group. The web is transferred from the second-last dryer group to the last dryer group when the web is at least 70 percent dry. The last dryer group includes upper and lower tiers, arranged in a double felted two tier configuration as described above, so the web extends in an open draw between each dryer cylinder of the upper and lower tiers. Latent curl is controlled during movement of the web through the last dryer group.

Still another aspect of the invention is apparatus of the type described in the previous aspect in which the web is transferred from the second-last dryer group to the last dryer group when the web has attained a percent dryness of at least M, as represented by the formula:

$$M=101-0.246\ (WRV)$$

in which M is sometimes referred to as the "critical moisture content" of the web and WRV equals the water retention value of the web.

Yet another aspect of the invention is a method for drying a web of paper. To practice the method, the web is passed through more than one dryer group for drying the web until the web is at least 70 percent dry. Each of the dryer groups to this point is a top felted, single tier dryer group for facilitating downward removal of broke. Subsequently, both sides of the web are dried to inhibit curl in the resultant web.

The invention has several advantages. The predominant top-felted dryers allow ready access to the dryer cylinders for operation and maintenance of the machine. Broke handling and removal from all of the top felted groups is done in a downward direction, thus eliminating the need for extensive scaffolding, operator platforms and conveyors which would be required for efficient access around bottom felted groups. The dryer groups can be arranged with all the group-to-group transfers located for direct access from the main operating floor. These transfers include the press-to-dryer transfer at the wet end of the dryer, the dryer group to dryer group transfers within the dryer, and the dryer-to-calender transfer at the dry end of the dryer. (The calender is not part of the dryer; it forms a desired finish on the surfaces of the paper.)

The machine can be threaded without threading ropes, and efficient curl control is possible. Additionally, the arrangement of the present invention can reduce the overall length of the paper machine, compared to an alternating single tier dryer, because some of the dryer cylinders can be stacked in at least one two tier group. The single tier part of the dryer achieves high average felt wrap angles on the dryer cylinders for improved drying rates, improved drivability and improved sheet restraint.

Furthermore, the proposed dryer group provides enhanced two-sided drying for improved curl control, as the last dryer cylinders in the two-tier dryer group can be used for a control. The last dryer cylinders have been found to be the most effective in terms of curl control.

The inventors have discovered that the single tier dryer groups, according to the present invention, are effective in reducing cross-directional shrinkage in the wet end of the dryer group. However, it has been further discovered that single-tier dryer groups have less effect in the last dry end group.

Comparative test results from trials indicate that for a BEL-CHAMP dryer group, the cross-directional shrinkage is nearly zero until the web dryness reaches a level of about 65 to 80 percent dry. After this point in a single tier group, the cross-machine direction (CD) shrinkage increases, although at a rate that is less than the shrinkage rate of a web dried with a conventional double felted, two tier dryer group. Shrinkage occurs even though alternating single tier dryer groups are utilized. For this reason, only slightly more shrinkage will occur if the last dryer group is arranged in a two tier configuration.

Furthermore, the two tier group provides an open draw where a tail cutting mechanism can be located. At the same time, the dryer cylinders in the two tier group are arranged with the felt rolls offset so as to reduce the length of the open draws in order to maintain sheet stability and to direct the tail into the next felt/dryer cylinder nip in order to thread the tail without the need for threading ropes.

DETAILED DESCRIPTION OF THE INVENTION

Figure 1:
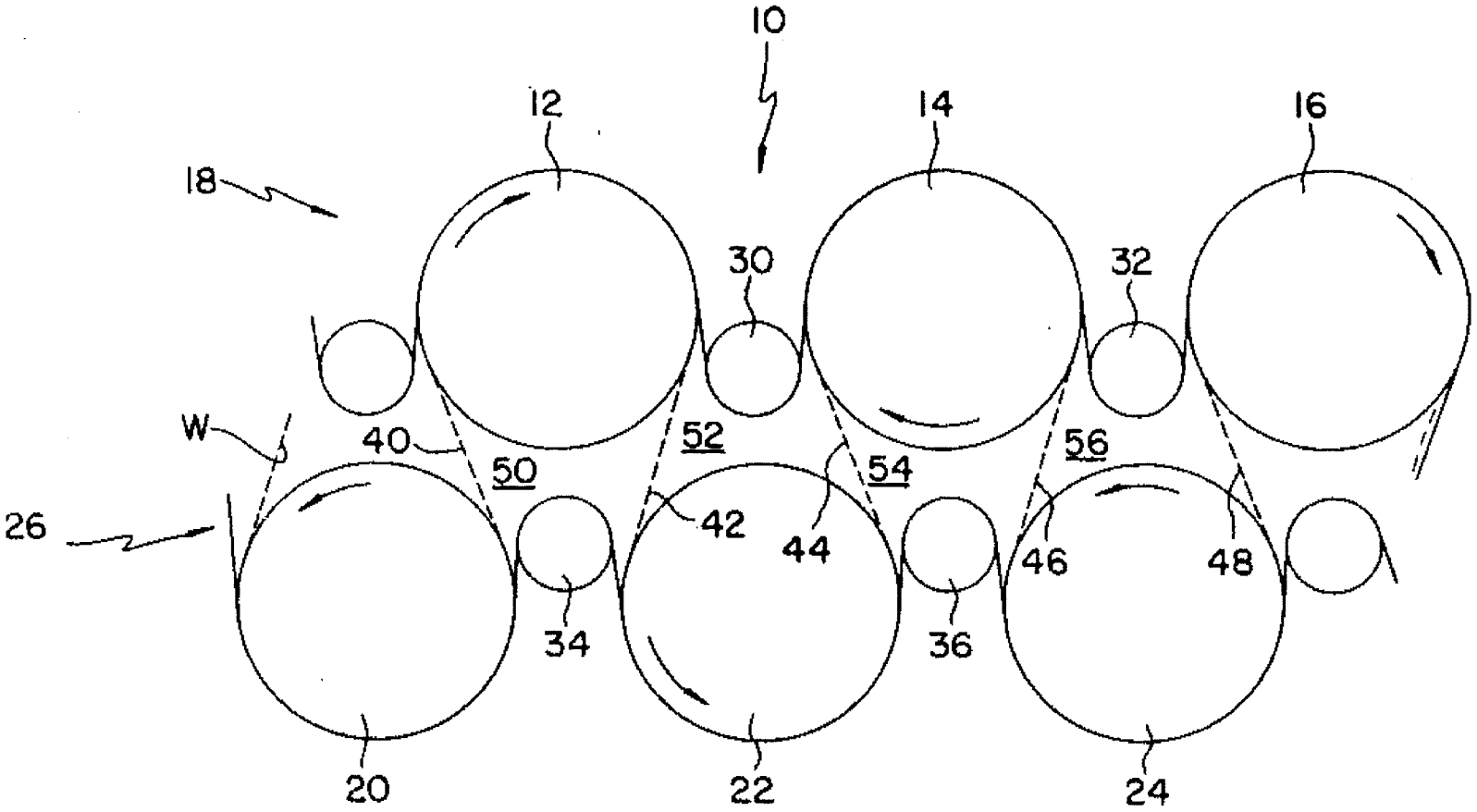
FIG. 1 PRIOR ART
FIG. 1 is a side elevational view of a prior art two tier, double felted dryer group.

This invention is illustrated by a description and drawings of a limited number of embodiments. Many other modifications and variations of the present invention will be readily apparent, however, to those skilled in the art after consideration of the detailed description and drawings presented here.

The scope of this patent is not limited to the preferred or specifically illustrated embodiments described in this specification. To the contrary, all modifications which are within the scope of any single claim at the end of this specification are protected by this patent. Each individual claim legally defines a patented invention.

Similar reference characters refer to similar parts throughout the various views of the drawings.

Referring now to the drawings, FIG. 1 is a side-elevational view of a typical two tier, double felted dryer group, generally designated 10, including dryer cylinders 12, 14 and 16 arranged as an upper tier, generally designated 18, and dryer cylinders 20, 22 and 24 arranged as a lower tier, generally designated 26.

The rolls 30 and 32 are located closely adjacent to and between adjacent dryer cylinders of the upper tier 18. The rolls 34 and 36 are located closely adjacent to and between adjacent dryer cylinders of the lower tier 26.

As can be seen from FIG. 1, the web W, as indicated by a dashed line, moves in open draws as shown at the points 40, 42, 44, 46 and 48 alternately between dryer cylinders of the upper and lower tiers 18 and 26, respectively.

Additionally, water vapor evaporating from the web W becomes trapped within the pocket areas 50, 52, 54 and 56, causing uneven drying of the resultant web.

Figure 2:
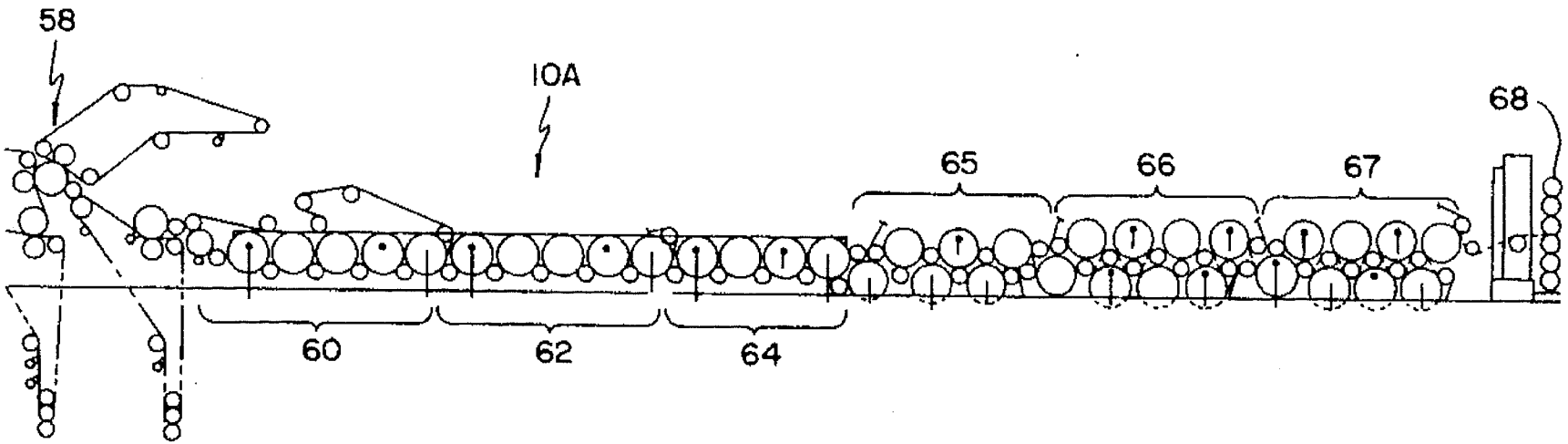
FIG. 2 PRIOR ART
FIG. 2 is a similar view of a prior art dryer which includes more than one top felted, single tier dryer group followed by more than one double felted, two tier dryer group.

FIG. 2 is a side-elevational view of a partial single tier dryer, generally designated 10A, in which the first portion of the dryer includes a press, generally designated 58, followed by more than one top felted, single tier dryer group, respectively, the three groups 60, 62 and 64.

The top felted dryer groups 60, 62 and 64 are followed by more than one double felted, two tier group, respectively the three groups 65, 66 and 67, which in turn are followed by a calender 68 which is at or close to the downstream end of the paper making machine.

Figure 3:
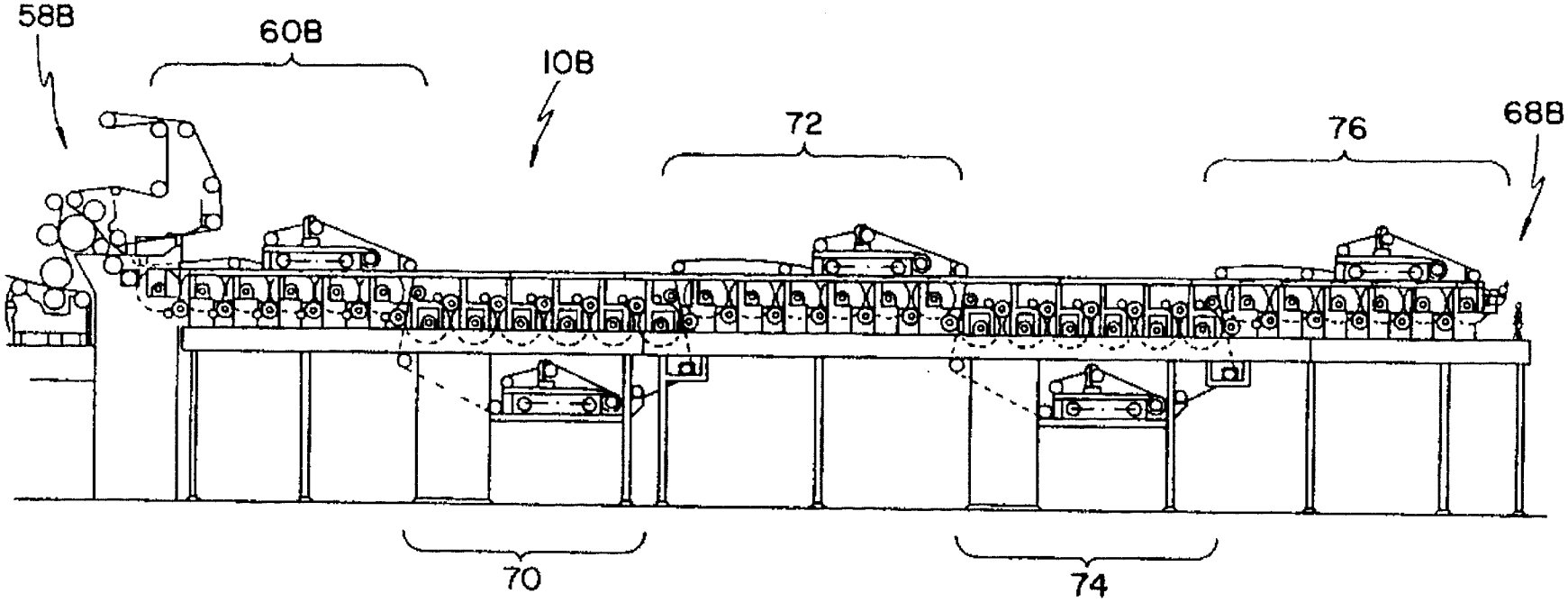
FIG.3 PRIOR ART
FIG. 3 is a similar view of a prior art BEL-CHAMP dryer group including alternate top and bottom felted dryer groups for drying alternate sides of the web.

FIG. 3 is a side-elevational view of a prior art BEL-CHAMP dryer group generally designated 10B. The dryer group 10B includes a top felted, single tier dryer group 60B followed by a bottom felted, single tier dryer group 70 for drying the opposite side of the web.

During movement of the web through the BEL-CHAMP dryer group 10B, alternate sides of the web are dried during movement of the web through succeeding dryer groups 70, 72, 74 and 76, the web being restrained against machine and cross-machine directional shrinkage by the felt pressing the web against the dryer cylinders and by the vacuum drawing the web against the felt as they wrap around the vacuum rolls. This restraint is nearly continuous during movement of the web from the press section 58B to the calender generally designated 68B.

Figure 4:
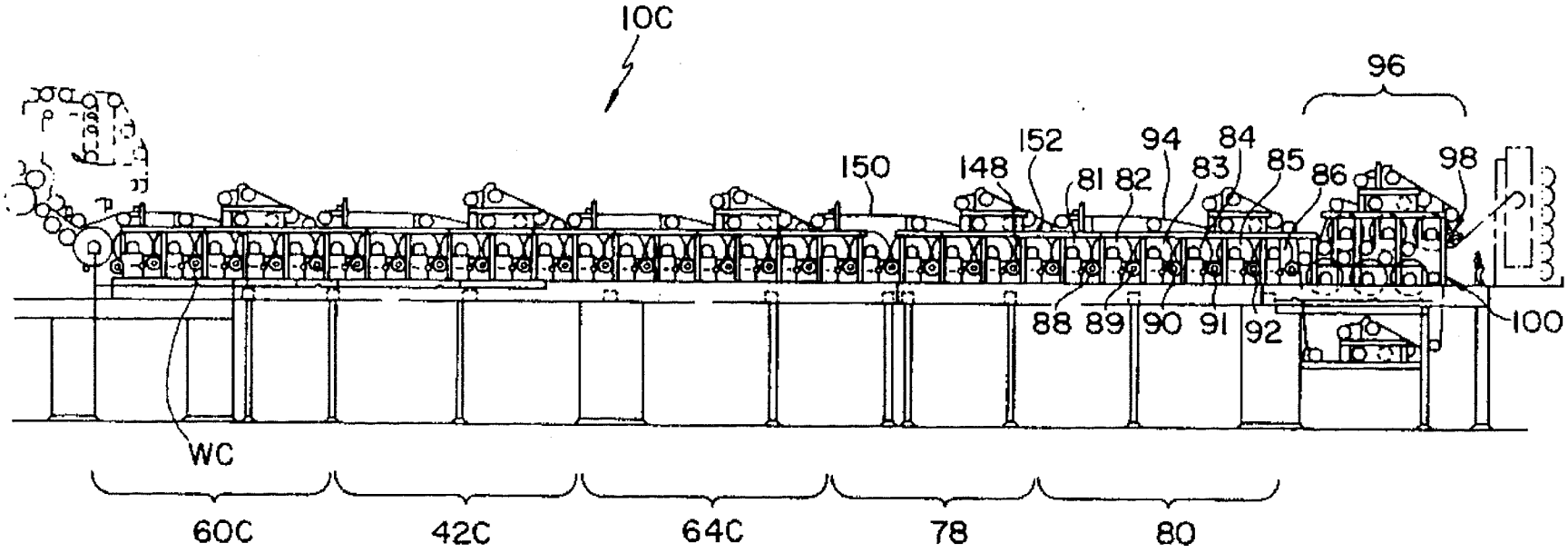
FIG. 4 is a similar view of the drying apparatus according to the present invention showing more than one top felted, single tier dryer group followed by a single, double felted dryer group.

FIG. 4 is a side-elevational view of a drying apparatus, generally designated 10C, made according to the present invention, for drying a web of paper WC. The apparatus 10C includes more than one dryer group, respectively groups 60C, 62C, 64C, 78 and 80, for drying the web WC.

Each of the dryer groups 60C, 62C, 64C, 78 and 80 includes more than one dryer cylinder. For example, the dryer group 80 includes the dryer cylinders 81, 82, 83, 84, 85 and 86 which are in a single tier configuration.

Also, more than one vacuum roll, specifically the rolls 88, 89, 90, 91 and 92, is arranged so each vacuum roll 88 to 92 is located between adjacent members of the dryer cylinders 81 to 86.

A dryer felt 94 extends alternately around each dryer cylinder 81 to 86 and each vacuum roll 88 to 92. Each of the dryer cylinders 81 to 86 is top felted so that broke removal is facilitated.

Each of the dryer groups 60C, 62C, 64C, 78 and 80 is arranged in succession and preferably, but not necessarily, without any open draw between successive dryer groups. The web WC is restrained against cross-machine and machine directional shrinkage during passage of the web WC through the dryer groups 60C, 62C, 64C, 78 and 80.

Figure 5:
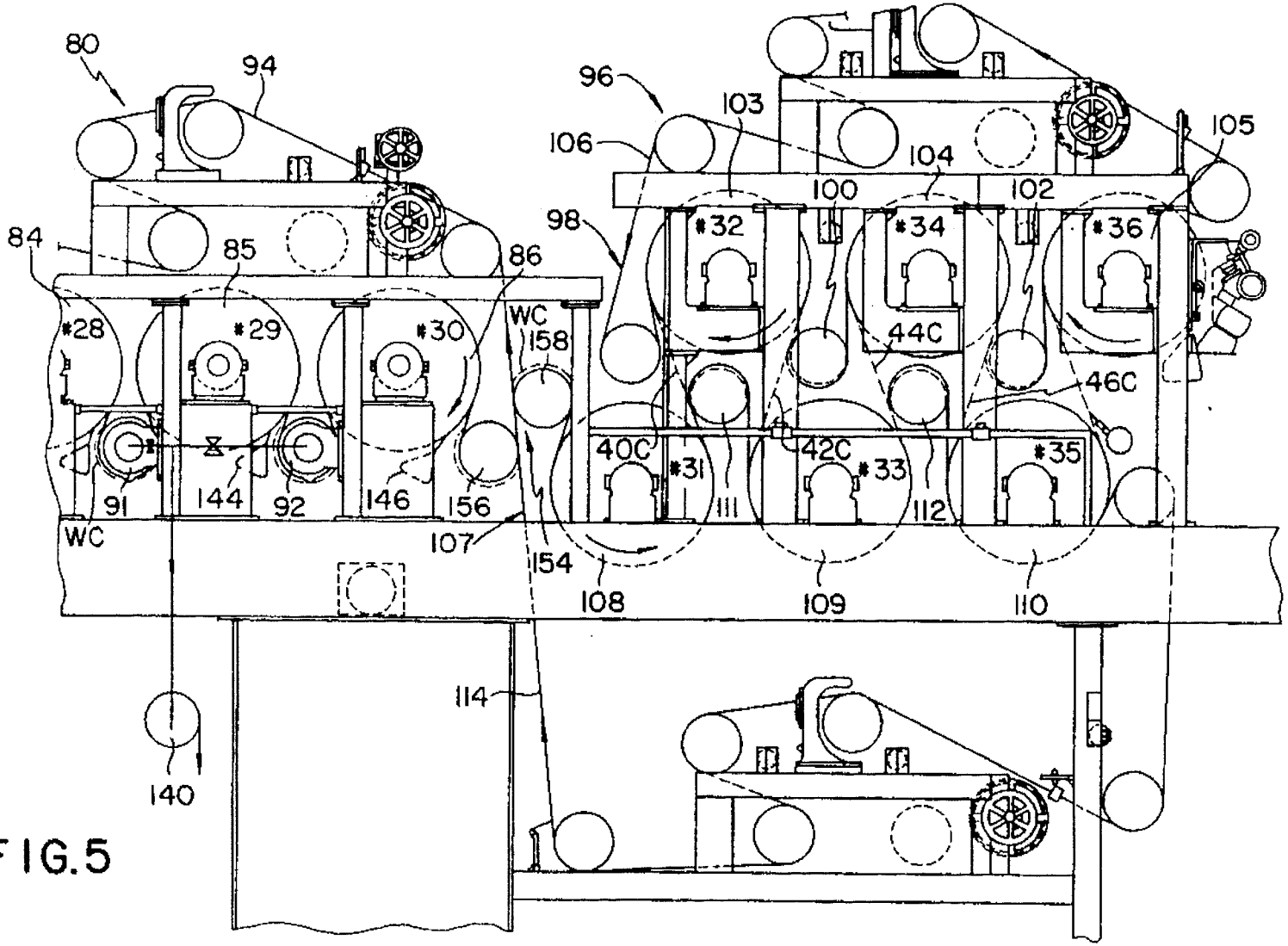
FIG. 5 is an enlarged view of the transfer between the top felted dryer groups to the single, double felted dryer group shown in FIG. 4.

A last dryer group, generally designated 96, is located downstream relative to the plurality of dryer groups 60C, 62C, 64C, 78 and 80 so the web WC is transferred, preferably but not necessarily without an open draw, between the second-last dryer group 80 and the last dryer group 96. FIG. 5 is an enlarged view Of the transfer to the last dryer group 96.

The last dryer group 96 includes an upper tier of dryer cylinders, generally designated 98, and an upper plurality of rolls 100 and 102 located between adjacent dryer cylinders 103, 104 and 104, 105 of the upper tier 98. An upper felt 106 extends alternately around each dryer cylinder 103 to 105 of the upper tier 98 and each roll 100 to 102 of the upper plurality of rolls.

The last dryer group 96 also includes a lower tier 107 of dryer cylinders 108, 109 and 110 and a lower plurality of rolls 111, 112 which are located between adjacent dryer cylinders 108, 109 and 109, 110 of the lower tier 107. A lower felt 114 extends alternately around each dryer cylinder 108 to 110 of the lower tier 107 and each roll 111 to 112 of the lower rolls.

The web WC extends in open draws 40C, 42C, 44C and 46C between each dryer cylinder of the upper and lower tiers 98 and 107, respectively, and any tendency of the web WC to curl (also referred to in this specification as "latent curl") is controlled (in other words, reduced or eliminated) during movement of the web WC through the last dryer group 96.

As shown in FIG. 4, the plurality of dryer groups includes five dryer groups 60C, 62C, 64C, 78 and 80, arranged in a substantially horizontal line. Minor deviations of individual dryer cylinders or tiers of cylinders from a strictly horizontal orientation are contemplated without departing from the invention, which most broadly does not require a horizontal orientation.

As shown in FIG. 5, the plurality of vacuum rolls 91 to 92 are each connected to a source of partial vacuum 140 so, during movement of the web WC around each of the vacuum rolls 91 to 92, the web WC is held against cross-machine and machine directional shrinkage. This occurs because the dryer felt 94 is located between the web WC and each of the vacuum rolls 91 and 92.

As shown in FIG. 5, each of the dryer groups, for example 80, further includes doctors such as 144 and 146 which cooperate with each dryer cylinder 84 to 86 of the plurality of dryer cylinders for assisting in the downward removal of broke.

The web WC, as shown in FIGS. 4 and 5, is transferred from one dryer group, for example 78, to a succeeding group, for example 80, without open draw.

More specifically, this transfer without open draw is accomplished by a lick-down transfer, which is well-known in the art. The transfer is carried out by supporting the web WC on the heated surface of a drying cylinder 148 (FIG. 4), a dryer felt 150 having been guided away from the drying cylinder 148 by a felt roll 152. The succeeding dryer felt 94 is guided into contact with the web WC supported by the drying cylinder 148 so the web WC is transferred to the succeeding felt 94, as is well-known in the art.

The web WC extends preferably without an open draw between the plurality of dryer groups 60C, 62C, 64C, 78 and 80 and the last dryer group 96 when the web has attained a dryness of at least about 70 percent, alternatively at least about 75 percent, alternately at least about 80 percent.

FIG. 5 shows a transfer, generally designated 154, between the plurality of drying groups 60C, 62C, 64C, 78 and 80 and the last dryer group 96.

More specifically, as shown in FIG. 5, the dryer group 80 also includes a downstream vacuum roll 156. The last dryer group 96 also includes an upstream vacuum roll 158 which is located adjacent to and downstream relative to the downstream vacuum roll 156. The web WC is sandwiched between the dryer felt 94 of the plurality of dryer groups and the lower felt 114 so the web WC is transferred from the dryer felt 94 to the lower felt 114 without open draw.

Figure 6:
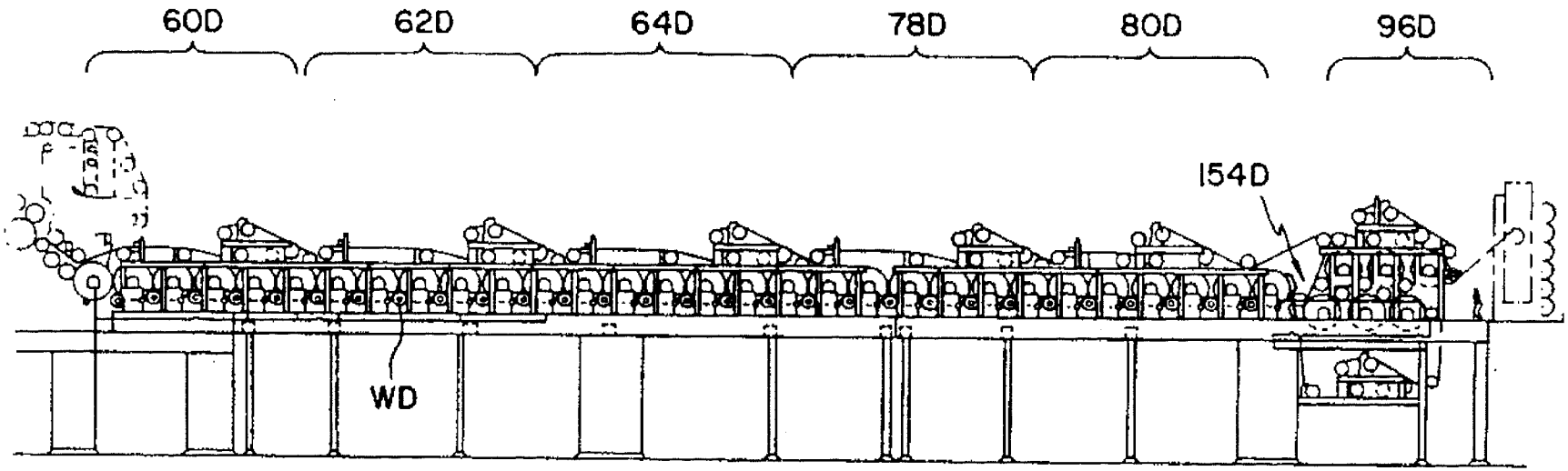
FIG. 6 is a similar view to that shown in FIG. 4 but shows an alternative embodiment of the present invention having another arrangement for transferring the web from the single felted groups to the double felted groups using blow boxes.

FIG. 6 is a side-elevational view showing an alternative transfer arrangement, generally designated 154D, for transferring a web WD from a first dryer section including more than one dryer group 60D, 62D, 64D, 78D and 80D to a second dryer section including at least one dryer group 96D.

Figure 7:
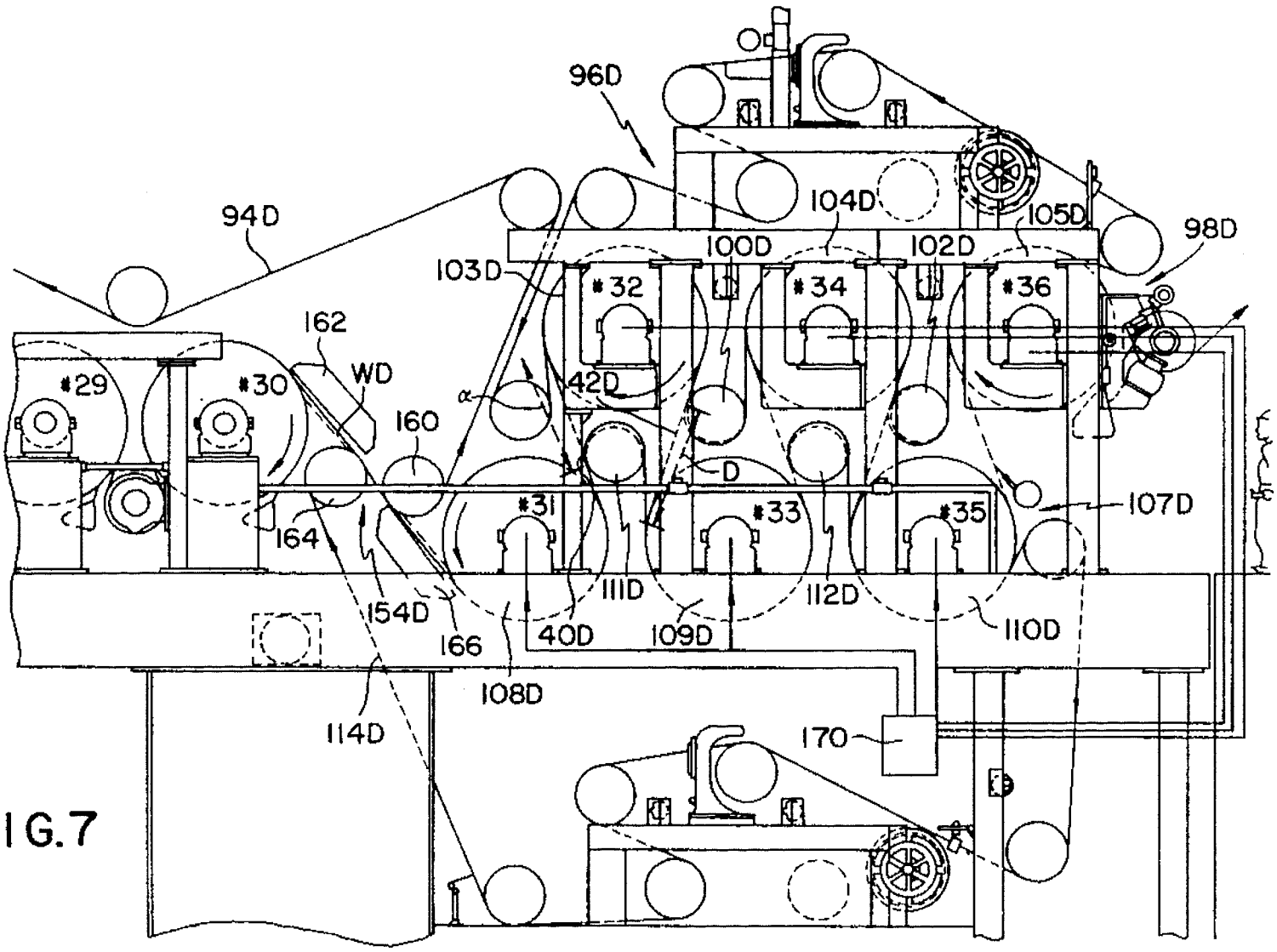
FIG. 7 is an enlarged view of the transfer arrangement shown in FIG. 6.

FIG. 7 is an enlarged view of the transfer 154D shown in FIG. 7 and includes a downstream felt roll 160 and a blow box 162 located adjacent to a dryer felt 94D and immediately upstream relative to the felt roll 160. The last single dryer group 96D also includes an upstream felt roll 164 located closely adjacent to the dryer felt 94D and upstream relative to the downstream felt roll 160.

A further blow box 166 is located closely adjacent to and downstream relative to the downstream felt roll 160 so the web WD is sandwiched between the dryer felt 94D and a lower felt 114D. The web WD is transferred without open draw from the dryer felt 94D to the lower felt 114D.

As shown in FIG. 7, at least some rolls 100D and 102D of the upper plurality of rolls are offset towards the adjacent upstream dryer cylinders 103D and 104D, respectively, of an upper tier 98D of dryer cylinders for reducing a distance D of the open draw 42D between each dryer cylinder 103D and 109D of the upper and lower tiers 98D and 107D, respectively.

Additionally, each roll 111D and 112D of the lower plurality or rolls is offset towards an adjacent upstream dryer cylinder 108D and 109D of the lower tier 107D of dryer cylinders so the open draw 40D between each dryer cylinder 108D and 103D of the lower and upper tiers 107D and 98D, respectively, is minimized, as indicated by the distance "D".

As shown in FIG. 7, the last dryer group 96D also includes control means 170 for controlling the steam pressure within each dryer cylinder 103D, 104D and 105D of the upper tier 98D and each dryer cylinder 108D, 109D and 110D of the lower tier 107D of dryer cylinders, which in turn controls the amount of heat transferred from the respective dryer cylinders to the web. Any latent tendency of the web WD to curl due to preferential drying of one side is compensated for by the application of differential steam pressure between succeeding dryer cylinders, resulting in sufficient preferential drying of the other side of the web to at least reduce, and preferably reduce to an acceptable level or substantially eliminate, the latent curl.

The necessary control apparatus can be as simple as the shut-off valves, typically ball valves, of each individual dryer cylinder. Some of the dryers can have their steam supply partially or completely shut off to regulate the relative drying capacity of the upper and lower tiers of dryers.

In an alternative arrangement, pressure regulating valves can be provided for individual dryers or groups of dryers to control steam pressure. Other control schemes include regulating the amount of condensate in the respective cylinders so their heat transfer rates to the web are different, heating or cooling the web by other means than controlling steam pressure (as by applying heating or cooling air caps) to change the temperature of the web or of certain dryer cylinders, and so forth. At a minimum, the control means comprises at least one valve capable of being operated to individually change the steam pressure delivered to at least one dryer cylinder. The valves may be operated manually, remotely, or automatically, and may be operated individually or in groups according to a variety of control schemes.

Figure 8:
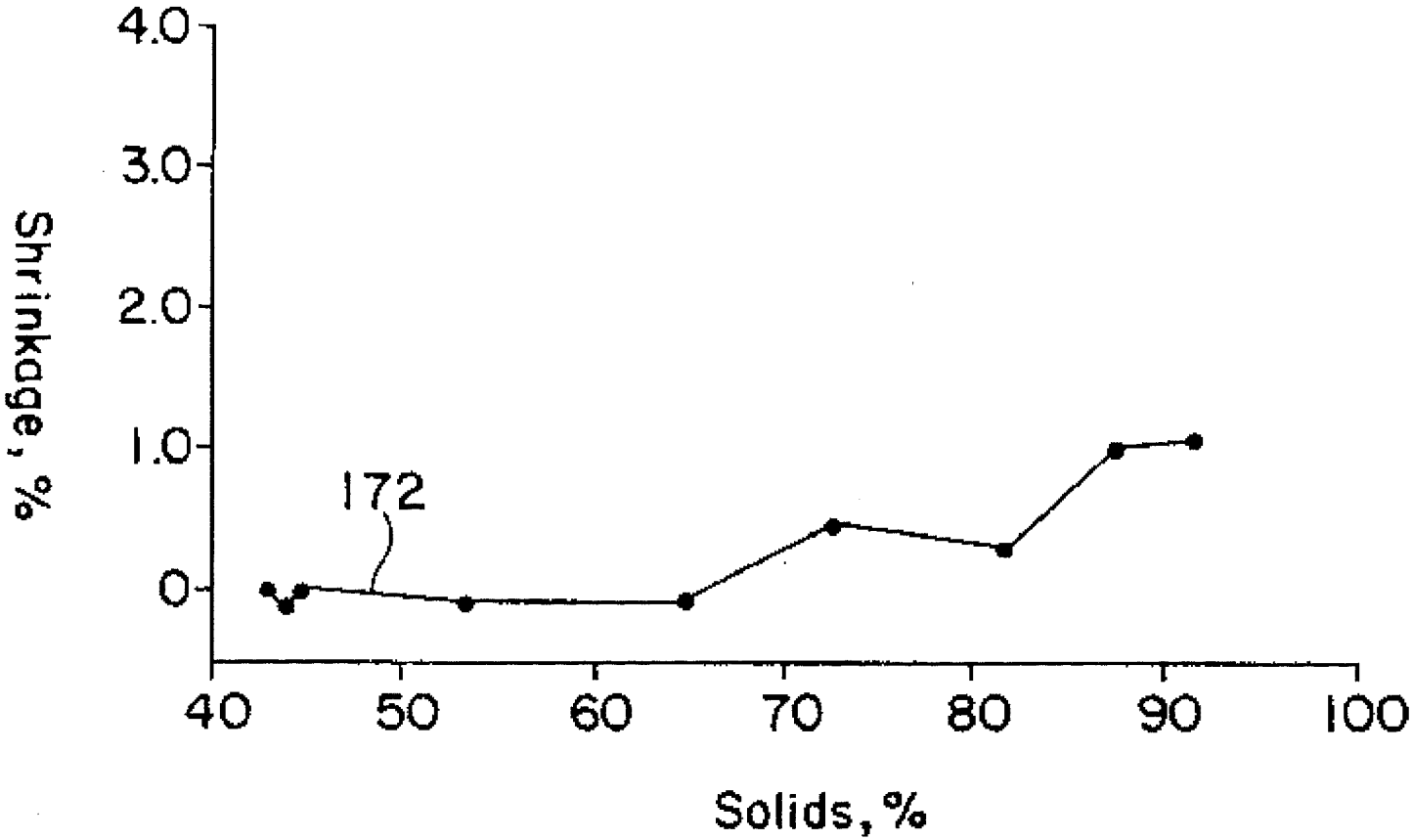
FIG. 8 is a graph generated from the results of trials showing the percentage of solids within the dried web relative to the percentage of shrinkage in a cross-machine direction of the web.
Figure 9:
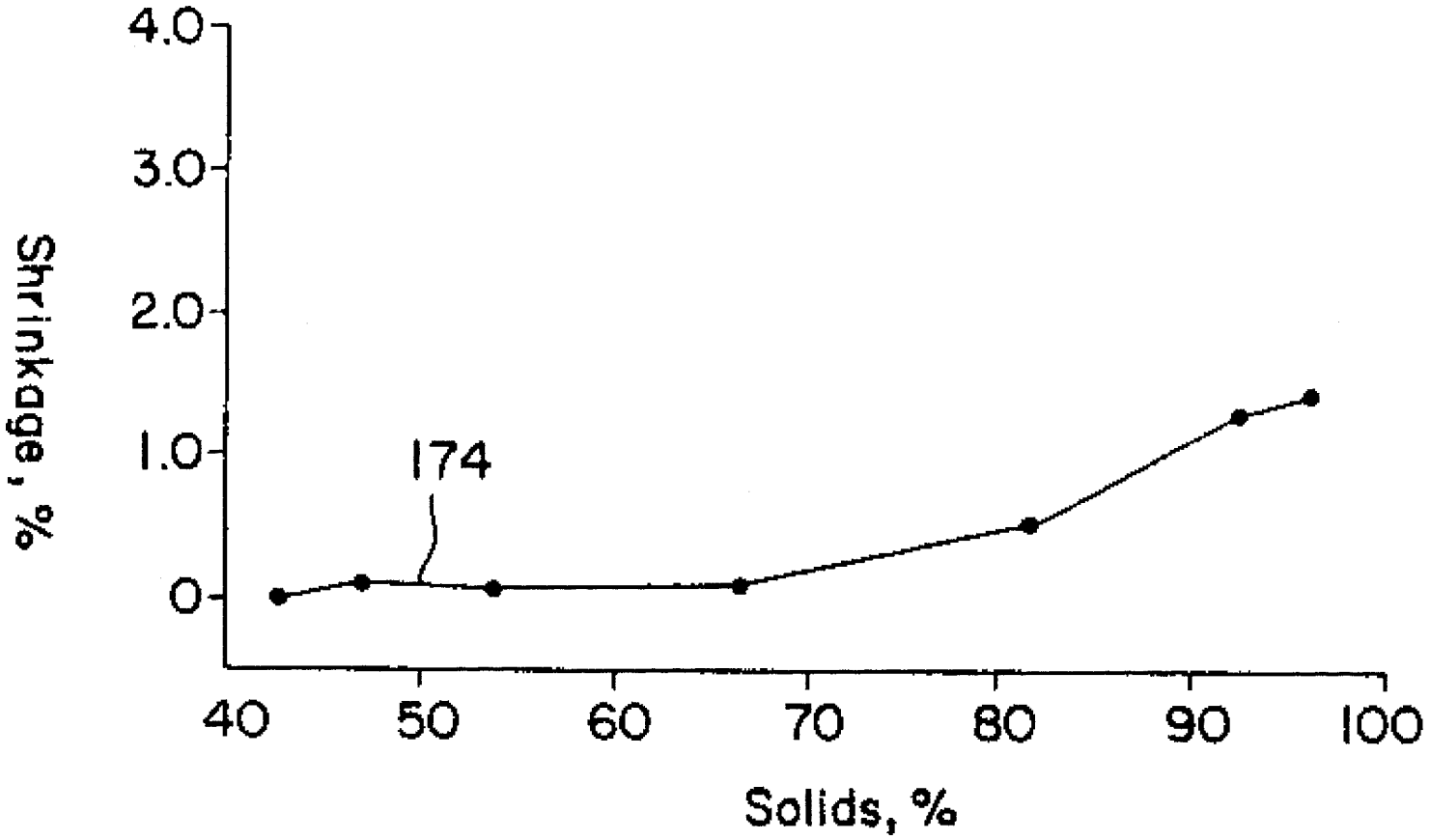
FIG. 9 is a graph similar to that shown in FIG. 8 but showing the results of trials for a wood-free coated machine.

FIGS. 8 and 9 show graphs 172 and 174, representing results obtained from commercial BEL-CHAMP dryer groups.

Figure 10:
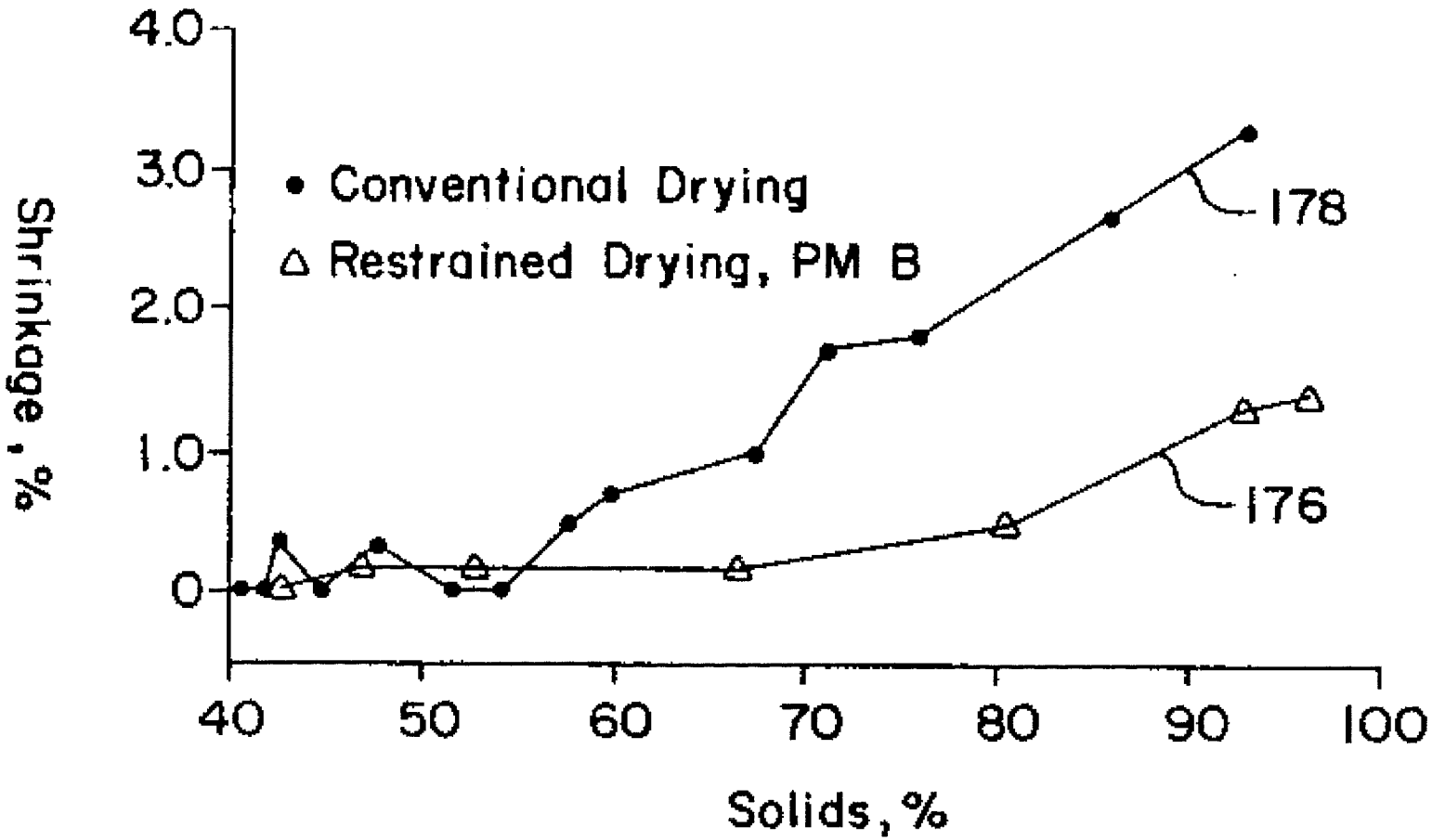
FIG. 10 is a graph comparing results obtained from a BEL-CHAMP dryer group and a conventional double felted dryer group, indicating that the amount of cross-machine directional shrinkage in the BEL-CHAMP arrangement remains approximately zero (0) until the web is at least 65 percent dry.

FIG. 10 shows two graphs. The first graph, 176, shows results from a BEL-CHAMP dryer group demonstrating that the cross-machine directional shrinkage remains substantially zero (0) until the web reaches a dryness of approximately 65 percent dry.

The other graph, 178, shows the results taken from trials conducted using a conventional two tier, double felted drying arrangement. In this instance, the cross-machine directional shrinkage rapidly increases as the web attains approximately 55 percent solids, meaning that the web is 55 percent dry.

The present embodiment provides the advantages of an all top felted dryer cylinder arrangement, therefore avoiding the problem of broke removal associated with bottom felted, single tier groups.

A two tier group is used at the dry end, and all the transfers are accomplished on the operating floor level. Also, all of the transfers between dryer groups are preferably closed draws until the web enters the two tier, double felted group.

The two tier group is utilized only after the web has attained a dryness of preferably over about 80%, when the effects of the single tier arrangement becomes less favorable. This dryness level may alternately be over about 75% or over about 70% dryness.

Although specific minimal dryness levels have been specified, it will be appreciated by those skilled in the art that different grades of paper tend to curl at different dryness levels.

Alternately, according to the present invention, the two tier dryer group can be located so the web reaches this group when the web has a particular critical moisture content. At the critical moisture content, the sheet has sufficient strength to be transferred through open draws, the machine direction draws required to maintain good runnability are low, and cross-machine directional shrinkage would begin to occur, even in an alternating single tier dryer group. The critical moisture content is contemplated to be an alternate indication of the optimal point for transferring the web from the single tier top-felted dryer group to the double tier group for controlling latent curl.

The aforementioned critical moisture content is not a fixed value of, for example, 70 percent dry. The value will depend on various properties of the pulp from which the sheet is being made, the sheet processing conditions, and the properties of the finished sheet. These properties are believed to include the resultant sheet wet and dry strengths, the degree of shrinkage, and the point at which unrestrained cross-machine directional shrinkage begins.

For purposes of the present invention, however, the sheet moisture content, which must be reached before the single tier dryer group can end and the two tier group can be used, is based on the water retention value (WRV) of the pulp. Pulps with higher WRVs will begin to shrink at a much lower web dryness than pulps with lower WRVs, and a shrinkage will be of a larger magnitude.

The critical moisture content for unrestrained webs has been measured and reported in "Effect of Water Retention Value (WRV) on the Paper Web Drying Process" by K. Przybysz and J. Czechowski in Cellulose Chem. Technology, Volume 20, Pages 451–464, published in 1986 (Przybysz, et al.).

The equation for the critical moisture (paper dryness) M given by Przybysz et al. is:

$$M=81-0.246\ (WRV)$$

In the formula, WRV is the water retention value expressed in percent, and M is the critical moisture content at which shrinkage begins, expressed in percent dryness. However, the "81" in this formula assumes unrestrained drying. The critical sheet dryness for a partially or fully restrained web will be higher, so the sheet dryness for the preferred dryer containing a series of single tier dryer groups should also be higher. For restrained drying, the critical moisture content is very approximately 20 percentage points higher than the unrestrained shrinkage point.

Such restraint may be achieved, for example, by employing at the wet end of the machine single tier drying sections which apply vacuum levels from their vacuum rolls of at least about six inches (water column) (about 1500 Pa) of vacuum, alternatively at least about eight inches (water column) (about 2000 Pa) of vacuum, alternatively at least about ten inches (water column) (about 2500 Pa) of vacuum. These vacuum levels are measured in the conventional manner, such as by tapping a gauge or sensor into the conduit which connects a source of vacuum to the interior of each vacuum roll.

Consequently, the inventors contemplate that the critical moisture content (paper dryness) for transferring the web from a series of top-felted single tier dryers to a two tier group might be ascertained from the equation:

$$M=101-0.246\ (WRY)$$

In the illustrated embodiment of the present invention, the dryer cylinders and the group-to-group transfers (including the press-to-dryer group transfer, the dryer group to dryer group transfers, and the dryer-to-calender transfer) are located for direct access from the main operating floor.

In this embodiment of the present invention, five single tier top felted groups are provided, each including six dryer cylinders. However, the groups can include more or fewer dryer cylinders— as few as two and as many as nine or more, for example. More or less dryer groups can also be provided.

The dryer cylinders can extend generally horizontally, and can be located above the operating floor at a height which makes them all directly accessible by the machine operators from the operating floor.

The dryer hood, which is not shown in FIG. 4, remains below the height of the press group. The ability to accommodate a low hood is still another advantage of the single tier dryer groups illustrated here.

A series of top felted groups shown in FIG. 4 is followed by at least one two tier dryer group which can be operated to control curl at the very end of the dryer. Some curl control is effected even if the upper and lower dryer cylinders are operated at the same steam pressures, thus equally drying the upper and lower sides of the web in the two-tier section. A higher degree of control is preferably maintained by fine-tuning the steam pressures in the top and bottom dryer cylinders so some or all of the lower cylinders receive more steam pressure than some or all of the upper cylinders. This preferentially dries the top of the web to counteract the preferential drying of the bottom of the web in the top-felted single tier groups.

The two tier group also increases the number of dryer cylinders that can be located in the available building length. The last dryer group also provides an open draw where a tail cutter can be installed.

In one embodiment of the present invention, the transfer between the last single tier group and the two tier group is accomplished using two vacuum rolls and a joint run of the two fabrics or felts to allow a stable transfer of the web.

In an alternative embodiment of the present invention, the transfer between the last single tier group and the two tier group is accomplished using two felt rolls and one or more blow boxes with two overlapping felts. This arrangement allows a stable transfer of the web but a longer distance between the cylinders is required.

The present invention also contemplates a transfer between the single felted drying groups and the double felted group by means of an open draw transfer.

In the two tier dryer group, each felt roll is located in an offset position relative to the center line between adjacent dryer cylinders, with the felt rolls being offset towards the wet end of the machine. The offset is adjusted so that the felt roll surfaces near the tangent point of the web run from one dryer cylinder to the next. Intermediate felt rolls could be plain rolls used in combination with ventilating blow boxes, PV rolls, or preferably BELVENT rolls. ("BELVENT" is a trademark of Beloit Corporation.) BELVENT rolls have two internal chambers, one for directing ventilation air into the dryer pocket, and the other for exhausting humid air from the dryer pockets. BELVENT rolls can be used to ventilate the dryer pockets, thereby keeping the pockets in flow balance and thereby stabilizing the transfer of the wet web.

The present invention also includes the method of passing the web through more than one dryer group for drying the web until the web is at least about 70 percent dry, each of the dryer groups being a top felted, single tier dryer group for facilitating downward removal of broke; and subsequently drying both sides of the web in order to inhibit curl in the resultant web. The web may instead be dried to more than about 70% dryness, or to more than about 75% dryness or to more than about 80% dryness, or from about 75% dryness to about 80% dryness, just before drying both sides of the web.

It will be understood by those skilled in the art that the step of drying the web from both sides can be carried out by hot air impingement, by using single or double felted two-tier drying arrangements, or of drying alternate sides of the web by moving the web through alternate top and bottom felted single tier dryer groups.

The present invention particularly relates to the direct effect of extending single-sided drying on the curl behavior of the web. More specifically, two-sided drying should be started at that point at which curl control is still effective enough to avoid curl in the finished sheet.

While not intending to be bound by the accuracy or completeness of any theory respecting how the invention works, the inventors contemplate that he invention works as it does for the following reasons.

The inventors have now recognized that curl control is most effective at the end of the dryer group, where the final dryness is being achieved.

Additionally, the inventors appreciate that some evaporation occurs from the side of the web opposite to the side that contacts the dryer cylinder. Air drying can be particularly significant for lightweight paper grades, like newsprint, fine paper and lightweight coated paper (LWC). Air drying of the non-contacting side of the web reduces the degree to which the other, dryer-contacting side of the web is preferentially dried.

The inventors also recognize that the early dryer cylinders primarily preheat the web while its heat transfer rate is high, and thus neither dry it very much nor heat it unequally. Further, the early dryer cylinders often use lower steam pressures in the cylinders to avoid picking.

Based on the aforementioned factors, the inventors now recognize that the web may contact a substantial number of dryer cylinders on one side first, before alternate-side drying is required to maintain low curl.

Furthermore, the inventors have discovered that one-sided drying can be continued even longer than what might be suggested from the aforementioned factors alone. This is because curl control is most effective at the end of the dryer group. Very little curl-inducing shrinkage of either the individual fibers or the fiber networks occurs at the wet end of the dryer group. The majority of the shrinkage forces are developed after the web has reached a low moisture content. As a result, the web can be dried through most of the dryer from one side only, without creating a problem with sheet curl.

Because of the complexities associated with shrinkage and the drying process, and the furnish factors, it is difficult to accurately predict the critical moisture content. The critical moisture content will be different for different grades and furnishes.

Another alternative approach to determining the critical moisture content is to measure the effect of single-sided drying directly in the laboratory for the desired furnish. This experiment was performed using a 64 grams per square meter (64 gsm) sheet made on a pilot paper machine. The sheets were dried from one side for a specific number of drying cycles before reversing the side of drying. Sheet curl was measured at the end of the drying process.

Significant curl was seen as the single-sided drying extended to above a point between 65% and 80% dryness.

Due to the number of variables that can influence the critical moisture (furnish, drying rate, basis weight, etc), the critical moisture has been recognized by the inventors to be at least 70 percent dry, with the presently preferred range being between 70 and 85 percent dry.

What is claimed is:

1. A paper making machine comprising:

A. an upstream portion capable of forming a wet web of paper having first and second sides;

B. a downstream end; and

C. a dryer between said upstream portion and said downstream end for removing water from the web, wherein said dryer includes:

i. a first dryer portion which is capable of preferentially drying a first side of the web to a dryness of at least about 70%; and ii. a second dryer portion which is located between said first dryer portion and the downstream end of said machine, which comprises at least one dryer group which is capable of drying each of said first and second sides of said web in relative amounts which at least reduce the degree of curl.

2. The paper making machine of claim 1, wherein said first dryer portion comprises at least one dryer group.

3. The paper making machine of claim 1, wherein said first dryer portion comprises at least one single-felted dryer group.

4. The paper making machine of claim 1, wherein said first dryer portion comprises at least one dryer group having more than one dryer cylinder.

5. The paper making machine of claim 4, wherein at least two of said dryer cylinders are substantially horizontally aligned.

6. The paper making machine of claim 4, wherein all of said dryer cylinders are substantially horizontally aligned.

7. The paper making machine of claim 4, wherein more than one dryer cylinder is a top-felted dryer cylinder.

8. The paper making machine of claim 4, wherein all of said dryer cylinders are top-felted dryer cylinders.

9. The paper making machine of claim 3, wherein at least one dryer group of said first dryer portion is a single tier dryer group.

10. The paper making machine of claim 1, wherein said first dryer portion is capable of drying the web to a dryness of at least about 75%.

11. The paper making machine of claim 1, wherein said first dryer portion is capable of drying the web to a dryness of at least about 80%.

12. The paper making machine of claim 1, wherein said first and second dryer portions are consecutively located.

13. The paper making machine of claim 1, wherein said second dryer portion comprises at least one two tier dryer group.

14. The paper making machine of claim 1, wherein said second dryer portion comprises at least one double felted dryer group.

15. The paper making machine of claim 1, wherein said second dryer portion comprises at least one double felted two tier dryer group.

16. The paper making machine of claim 1, wherein said second dryer portion comprises control apparatus capable of changing the relative degree of drying of the first and second sides of a web.

17. The paper making machine of claim 16, wherein said second dryer portion comprises at least one two tier dryer group.

18. The paper making machine of claim 17, wherein said two tier dryer group comprises upper and lower tiers of dryer cylinders.

19. The paper making machine of claim 18, wherein said upper and lower tiers of dryer cylinders are located generally horizontally.

20. The paper making machine of claim 18, wherein said control apparatus is capable of changing the relative drying capacity of at least one dryer cylinder of one said tier relative to at least one dryer cylinder of the other said tier.

21. The paper making machine of claim 18, wherein at least one said dryer cylinder is heated by apparatus which delivers steam to said cylinder and said control apparatus comprises at least one valve capable of being operated to individually change the steam pressure delivered to said cylinder.

22. The paper making machine of claim 18, wherein said upper and lower tiers each comprise more than one dryer cylinder.

23. The paper making machine of claim 22, wherein said control apparatus is capable of changing the aggregate drying capacity of the dryer cylinders of one said tier relative to the aggregate drying capacity of the dryer cylinders of the other said tier.

24. The paper making machine of claim 23, wherein said control apparatus is capable of individually changing the drying capacity of each of the dryer cylinders of one said tier.

25. The paper making machine of claim 18, wherein said control apparatus is capable of individually changing the drying capacity of each of the dryer cylinders of said two tier dryer group.

26. The paper making machine of claim 1, wherein said second dryer portion includes a dryer group which is the last dryer group of said machine.

27. The paper making machine of claim 1, wherein said second dryer portion includes a two tier dryer group which is the first two tier dryer group in the machine.

28. The paper making machine of claim 1, wherein said second dryer portion comprises a dryer group which is capable of alternately drying the first side of the web and the second side of the web.

29. The paper making machine of claim 1, wherein said first dryer portion comprises at least two dryer groups.

30. The paper making machine of claim 29, wherein said at least two dryer groups are each capable of preferentially drying the first side of the web.

31. The paper making machine of claim 29, wherein said at least two dryer groups are single-felted dryer groups.

32. The paper making machine of claim 31, wherein said at least two dryer groups are top-felted dryer groups.

33. The paper making machine of claim 1, wherein said first dryer portion comprises at least three dryer groups, each capable of preferentially drying the first side of the web.

34. The paper making machine of claim 33, wherein said at least three dryer groups are single-felted dryer groups.

35. The paper making machine of claim 34, wherein said at least three dryer groups are top-felted dryer groups.

36. The paper making machine of claim 33, wherein said at least three dryer groups are consecutive dryer groups.

37. The paper making machine of claim 1, wherein said first dryer portion comprises at least four dryer groups, each capable of preferentially drying the first side of the web.

38. The paper making machine of claim 37, wherein said at least four dryer groups are single-felted dryer groups.

39. The paper making machine of claim 38, wherein said at least four dryer groups are top-felted dryer groups.

40. The paper making machine of claim 1, wherein said first dryer portion comprises at least five dryer groups, each capable of preferentially drying the first side of the web.

41. The paper making machine of claim 40, wherein said at least five dryer groups are single-felted dryer groups.

42. The paper making machine of claim 41, wherein said at least five dryer groups are top-felted dryer groups.

43. The paper making machine of claim 1, wherein said first dryer portion comprises more than one dryers group, each a top-felted, single-felted group.

44. A drying apparatus for drying a web of paper, said apparatus comprising:

a plurality of drying groups capable of drying the web to a dryness of at least about 70%;

each of said drying groups including:

a plurality of dryers disposed in a single tier configuration;

a plurality of vacuum transfer rolls, each vacuum roll being disposed between adjacent dryers of said plurality of dryers;

a dryer felt extending alternately around each dryer and each vacuum roll, the arrangement being such that each of said dryers is top felted so that broke removal is facilitated, each of said drying groups being arranged in succession;

a further drying group only disposed downstream relative to said plurality of drying groups such that the web extends between said plurality of drying groups and said further drying said further drying group including: group;

an upper tier of dryers;

an upper plurality of rolls disposed between adjacent dryers of said upper tier;

an upper felt extending alternately around each dryer of said upper tier and each roll of said upper plurality of rolls;

a lower tier of dryers;

a lower plurality of rolls disposed between adjacent dryers of said lower tier; and a lower felt extending alternately around each dryer of said lower tier and each roll of said lower rolls, the arrangement being such that the web extends in open draw between each dryer of said upper and lower tiers so that any tendency of the web to curl is controlled during movement of the web through said further drying group.

45. A drying apparatus for drying a web of paper, said apparatus comprising:

a plurality of drying groups for drying the web;

each of said drying groups including:

a plurality of dryers disposed in a single tier configuration;

a plurality of vacuum rolls, each vacuum roll being disposed between adjacent dryers of said plurality of dryers;

a dryer felt extending alternately around each dryer and each vacuum roll, the arrangement being such that each of said dryers is top felted so that broke removal is facilitated, each of said drying groups being arranged in succession;

a further single drying group only disposed downstream relative to said plurality of drying groups such that the web extends between said plurality of drying groups and said further drying group;

said further drying group including:

an upper tier of dryers;

an upper plurality of rolls disposed between adjacent dryers of said upper tier;

an upper felt extending alternately around each dryer of said upper tier and each roll of said upper plurality of rolls;

a lower tier of dryers;

a lower plurality of rolls disposed between adjacent dryers of said lower tier;

a lower felt extending alternately around each dryer of said lower tier and each roll of said lower rolls, the arrangement being such that the web extends in open draw between each dryer of said upper and lower tiers so that any tendency of the web to curl is controlled during movement of the web through said further drying group; and the web extending between said plurality of drying groups and said further drying group when the web has attained a dryness of at least 70 percent dry.

46. A method for drying a web of paper, said method comprising the steps of:

passing the web through a plurality of drying groups for drying the web until the web is at least 70 percent dry, each of the drying groups being a top felted, single tier drying group for facilitating downward removal of broke; and subsequently drying both sides of the web in order to inhibit curl in the resultant web.

47. A method as set forth in claim 46, wherein the web is dried to within the range 75 to 80 percent dry prior to the step of drying both sides of the web.

48. The paper making machine of claim 1, wherein said first dryer portion is capable of producing latent curl in the web.

* * * * *

UNITED STATES PATENT AND TRADEMARK OFFICE

CERTIFICATE OF CORRECTION

PATENT NO. : 5,542,193

DATED : August 6, 1996

INVENTOR(S) : Duke N. Sims and Gregory L. Wedel

It is certified that error appears in the above-indentified patent and that said Letters Patent is hereby corrected as shown below:

Column 1, line 32: "a" should be deleted.

Column 15, line 44: "group;" was omitted after --drying--.

Column 15, line 45: "group;" should be deleted after --including--.

Signed and Sealed this

Eighteenth Day of February, 1997

*Attest:*

*Attesting Officer*

Bruce Lehman

BRUCE LEHMAN

*Commissioner of Patents and Trademarks*